US008464468B2

(12) United States Patent
Sommer et al.

(10) Patent No.: US 8,464,468 B2
(45) Date of Patent: Jun. 18, 2013

(54) DRIVE UNIT FOR GARAGE DOORS WITH UNIVERSAL ELECTRIC CONNECTION OPTIONS

(75) Inventors: Frank Sommer, Kirchheim/Tech (DE); Ralf Weissinger, Zell u.A. (DE)

(73) Assignee: Sommer Antriebs-und Funktechnik GmbH, Kirchheim (DE)

( * ) Notice: Subject to any disclaimer, the term of this patent is extended or adjusted under 35 U.S.C. 154(b) by 664 days.

(21) Appl. No.: 12/160,864

(22) PCT Filed: Dec. 19, 2006

(86) PCT No.: PCT/EP2006/012210

§ 371 (c)(1),
(2), (4) Date: Jul. 8, 2010

(87) PCT Pub. No.: WO2007/087878

PCT Pub. Date: Aug. 9, 2007

(65) Prior Publication Data

US 2011/0056137 A1 Mar. 10, 2011

(30) Foreign Application Priority Data

Jan. 14, 2006 (DE) ..... 10 2006 001 892

(51) Int. Cl.
*E05D 15/38* (2006.01)
*E05F 15/10* (2006.01)

(52) U.S. Cl.
USPC ..... 49/358; 49/360; 49/199; 49/197; 49/324; 160/188

(58) Field of Classification Search
USPC ..... 49/358, 360, 197, 199, 409, 404, 49/324; 160/188; 191/22 R, 23 R; 104/172.1, 104/172.4
See application file for complete search history.

(56) References Cited

U.S. PATENT DOCUMENTS

| | | | | |
|---|---|---|---|---|
| 3,331,428 | A * | 7/1967 | Ford | 160/331 |
| 3,374,823 | A * | 3/1968 | Ford | 160/331 |
| 3,397,488 | A * | 8/1968 | Goldstein | 49/199 |
| 4,437,506 | A * | 3/1984 | Ogita | 160/331 |
| 5,036,899 | A * | 8/1991 | Mullet | 160/189 |
| 6,865,848 | B2 * | 3/2005 | Krimmel | 49/409 |
| 7,748,167 | B2 * | 7/2010 | Sommer et al. | 49/358 |
| 2003/0172592 | A1 * | 9/2003 | Krimmel | 49/409 |
| 2008/0083167 | A1 * | 4/2008 | Olmsted et al. | 49/199 |
| 2011/0271596 | A1 * | 11/2011 | Schaaf | 49/358 |

FOREIGN PATENT DOCUMENTS

| | | | |
|---|---|---|---|
| DE | 9112357 | | 3/1992 |
| DE | 9112357 | * | 4/1992 |
| DE | 196 48 147 C1 | | 6/1998 |
| DE | 102 27 110 A1 | | 1/2004 |
| EP | 1541793 A1 | * | 4/2004 |
| EP | 1541793 | | 6/2005 |

OTHER PUBLICATIONS

EPO machine translation of Description for DE112357.*

(Continued)

*Primary Examiner* — Katherine Mitchell
*Assistant Examiner* — Marcus Menezes
(74) *Attorney, Agent, or Firm* — Venable LLP; Robert Kinberg

(57) ABSTRACT

A drive unit for a door includes a guiding device comprising guide rail and a guide element extending in a movement direction of the door. A drive device arranged inside a carriage moves back and forth along the guide rail and is engaged in the guide element. The drive unit is supplied with power via the guide rail and the guide element. Electrical plug connectors are provided on an external power source for the electrical connection of the guide element and the guide rail.

15 Claims, 3 Drawing Sheets

OTHER PUBLICATIONS

EPO machine translation of Claims for DE112357.*

German Office Action dated Jan. 20, 2011, issued in related German Patent Application No. 10 2006 001 892.3-23, and an English-language translation.

International Search Report for PCT/EP2006/012210 dated May 7, 2007.

Written Office Action from International Search Office dated May 7, 2007.

* cited by examiner

DRIVE UNIT FOR GARAGE DOORS WITH UNIVERSAL ELECTRIC CONNECTION OPTIONS

CROSS-REFERENCE TO RELATED APPLICATIONS

This application is a National Stage Application of PCT/EP2006/012210, filed Dec. 19, 2006, which designates the United States and claims the priority of German Application No. 10 2006 001 892, filed Jan. 14, 2006.

BACKGROUND OF THE INVENTION

The invention relates to a drive unit for a door.

A drive unit of this type is know from the German Patent Application DE 102 27 110 A1. This drive unit functions as a garage door drive. As a component of the drive unit, a guide rail with therein disposed guide element in the form of a tensioned chain is mounted on the garage ceiling. A carriage can be moved back and forth along the guide rail with the aid of an electric motor, wherein the electric motor engages via a toothed gear in the chain. The carriage itself is connected is hinged with the aid of a rod to a door panel. The electric motor is controlled with the aid of an external control unit. Depending on the drive, the electric motor moves the carriage back and forth in a predetermined direction along the guide rails, thereby lowering or lifting the door panel and opening or closing the garage.

Inserted into the guide rail is an insert element, which contains a fixture for tensioning the chain that functions as a guide element. A connecting cable furthermore ends at the insert element and leads to the external control unit, which is preferably attached to one wall of the garage and can be connected there to an outlet for the power supply. Power to the electric motor inside the carriage is supplied via the chain and the guide rail. One lead of the connecting cable is embodied hook-shaped in this case and is conductively connected to the guide element tensioning fixture that is connected to the chain. A different lead of the connecting cable is conducted to a contact that ends on the side of the insert element and fits flush against the guide rail.

The electrical contact, embodied in this way, for supplying power to the electric motor requires an undesirably high expenditure for the assembly and installation.

SUMMARY OF THE INVENTION

It is therefore the object of the present invention to provide a drive unit of the aforementioned type, which makes it possible to realize an easily established and universally usable contact to external units.

The above and other objects are achieved according to the invention by the provision of a drive unit for a door, which in one embodiment includes a guiding device that extends in a movement direction of the door and comprises a guide rail and a guide element; a carriage including a drive device disposed inside the carriage, the carriage being movable back and forth along the guide rail and being engaged in the guide element, herein the drive device is supplied with power via the guide rail and the guide element; and electrical plug connectors arranged to electrically connect the guide element and the guide rail to an external power source.

The inventive drive unit for a door is provided with a guiding device extending in movement direction of the door, comprising a guide rail and a guide element, as well as a drive unit arranged inside a carriage that can be moved back and forth along the guide rail and is engaged in the guide element, wherein this drive unit is supplied with power via the guide rail and the guide element. Plug connectors are provided for the electrical connection of the guide element and the guide rail to an external power source.

The plug connectors according to the invention provide a flexible and quickly established option for connecting the drive unit traversing inside the carriage.

It is particularly advantageous if the electrical plug connectors offer a universal connection option, which can be used to realize different types of connection configurations.

According to one advantageous embodiment of the invention, electrical spring-loaded contacts as components of the electrical plug connectors are integrated into a connecting housing, which can be fitted onto the guide rail to make contact with the electrical contacts provided thereon. With this type of contacting, power can be supplied easily to the guide element and the guide rail and thus to the traversing drive unit inside the carriage.

Differently configured connections can be realized for the drive unit according to the invention by using a suitable embodiment of the connecting housing.

According to a first embodiment, the connecting housing can be embodied as housing with therein integrated control unit for controlling the drive unit. With this configuration, the control unit is directly connected to the guide rail along which the carriage containing the drive unit can traverse.

The connecting housing for a different embodiment can be a component of an adapter, from which a cable extends to a control unit, which in this case is located at a distance to the guide rail.

Since both variants are provided with the same electrical connection and are also embodied identical with respect to the mechanical interface parameters, the connecting housings of these variants can be exchanged easily and quickly in order to modify a connection configuration.

According to one particularly advantageous embodiment of the invention, an insert element is inserted into the guide rail, which is provided with means for supplying power as well as with tensioning fixtures for tensioning the guide element.

For this embodiment, an electrical contact is exposed on one wall of the insert element, which makes contact with to an electrical spring-loaded contact of the connecting housing once the connecting housing is fitted onto the guide rail with therein disposed insert element, thereby establishing the conducting connection to the guide element. A planned second electrical spring-loaded contact is advantageously fitted directly onto the guide rail when sliding on the connecting housing. As a result, the guide rail and the guide elements can be connected to an external power supply using a very low number of components and extremely low structural expenditure. Power can thus be supplied easily and with little expenditure to the drive unit via the guide element and the guide rail.

BRIEF DESCRIPTION OF THE DRAWINGS

The invention is explained in the following with the aid of the drawings, which show in.

DETAILED DESCRIPTION

Figure 1:
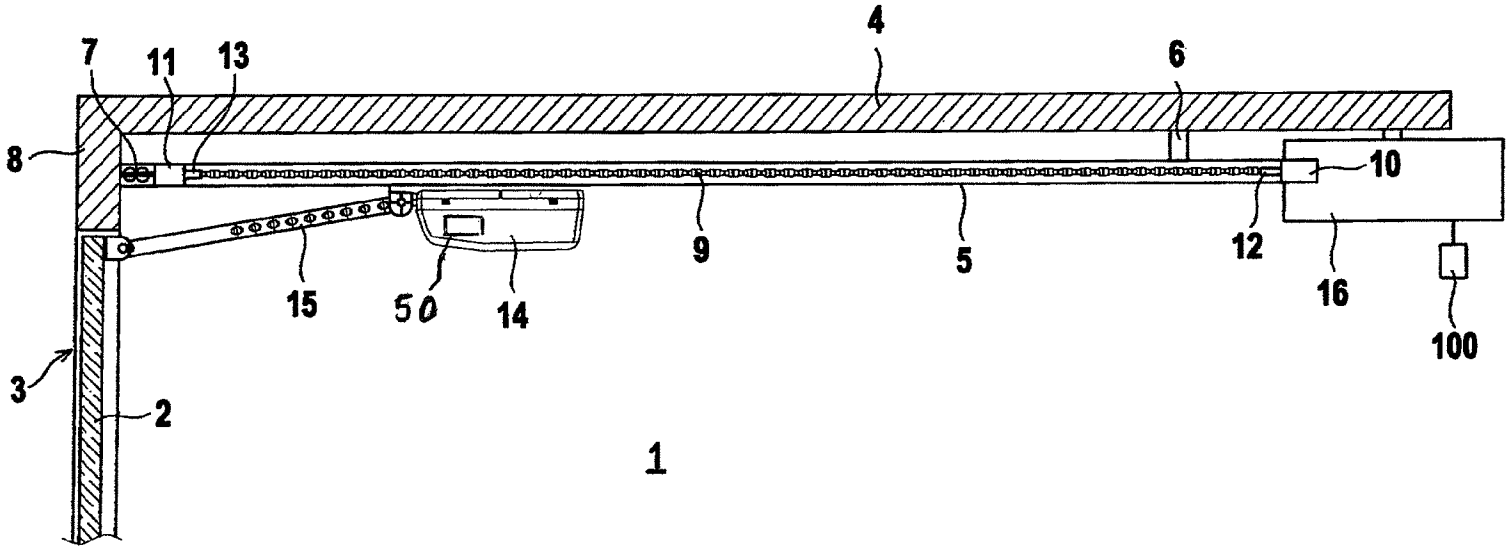
FIG. 1: A schematic representation of a first exemplary embodiment of a drive unit for a door.

FIG. 1 shows a first exemplary embodiment of a drive unit 1 for a door, wherein this door in the present case is a garage door 2. FIG. 1 shows a longitudinal section through the garage door 2 in the closed state, in which it is located inside a door opening 3 in a garage wall. In this closed state, the plane for the garage door 2 extends in a vertical plane and closes off the door opening 3.

The drive unit 1 is used to operate the garage door 2, wherein this door can be moved between an open position and a closed position. In the open position, the garage door 2 is arranged below the garage ceiling 4, thereby exposing the door opening 3.

A guide rail 5 that is mounted directly below the ceiling 4 of the garage is provided as a component of the drive unit 1. The guide rail 5 is attached in this case with holders 6, 7 to the ceiling 4, as well as to a lintel 8 that adjoins the ceiling 4 and delimits the garage door opening 3 on the top.

The guide rail 5 is embodied as a C-shaped profile, with a chain 9 extending as guide element on the inside of the guide rail 5. Respectively one insert element 10, 11 is inserted into the longitudinal open ends of the guide rail 5 and is secured in this position. The ends of the insert elements 10, 11 are preferably expanded, relative to the section of the insert elements 10, 11 that are inserted further into the guide rail 5, so that the expanded ends of the insert elements 10, 11 fit flush against the sides of the longitudinal ends of the guide rail 5. The insert elements 10, 11 are provided with guide element tensioning fixtures 12, 13, intended for tensioning the chain 9 inside the guide rail 5.

A carriage 14 is positioned so as to move back and forth along the guide rail 5. The carriage 14 is hinged with the aid of a rod 15 to the garage door 2. An electric motor 50 is provided in the carriage 14 as a drive device. The electric motor 50 is connected via a toothed gear, also not shown herein, to the chain 9. The electric motor 50 drives the toothed gear, thus moving the carriage 14 in a predetermined direction along the guide rail 5. As a result, the garage door 2 is opened or closed, depending on the direction of movement for the carriage 14.

The electric motor 50 is supplied with power via the guide rail 5 and the chain 9. The electric motor 50 is controlled via a control unit 16, which is connected via an outlet to a power supply. The control unit 16 thus supplies power via the guide rail 5 and the chain 9 to the electric motor. With the embodiment according to claim 1, the control unit 16 is fitted onto a longitudinal side end of the guide rail 5, with therein disposed insert element 10.

Figure 2:
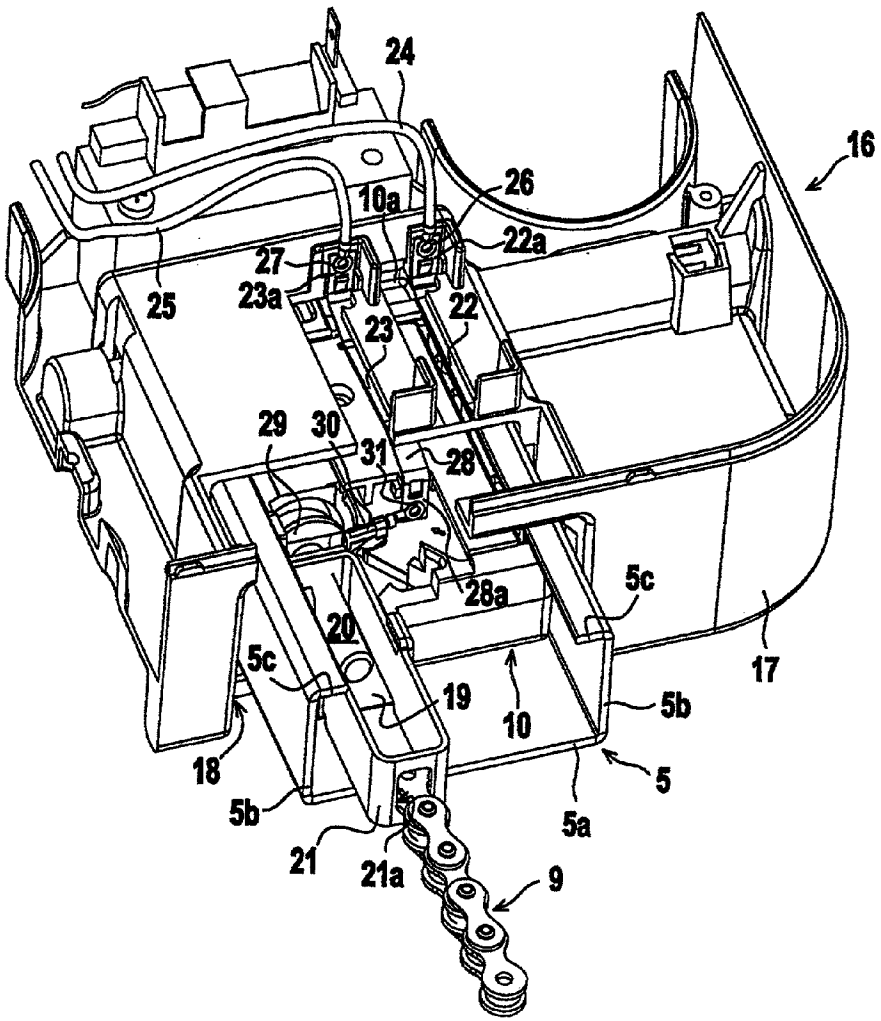
FIG. 2: A perspective representation of a detail of the drive unit according to FIG. 1.

FIG. 2 shows a perspective representation of a detail of the control unit 16, as well as the segment of the guide rail 5 that is located in the region of the control unit 16. The control unit 16 is integrated into a control unit housing 17. This control unit housing 17 also accommodates all electrical and electronic components necessary for activating the electric motor. The control unit housing 17 at the same time functions as connecting housing for directly connecting the control unit 16 to the guide rail 5 with therein disposed insert element 10. An insert opening 18 for inserting the guide rail 5 is provided for this in the front wall of the control unit housing 17, which is facing the guide rail 5. The insert opening 18 cross section is adapted to the cross section of the guide rail 5. The guide rail 5 that is inserted into the opening 18 is preferably secured in place with latching means or the like.

FIG. 2 illustrates that the metal C-shaped profile that forms the guide rail 5 comprises a bottom section 5*a* with two vertically projecting side walls 5*b*. Each side wall 5*b* is adjoined by an end strip 5*c* that projects from the respective side wall 5*c* toward the center of the guide rail 5. The end strips 5*c* delimit the top opening of the guide rail 5.

The insert elements 10, 11, of which only the insert body 10 is shown in FIG. 2, rest form-fittingly against the inside walls of the guide rail 5. In each case, the rear portion of the insert element 10 projects past the end of the guide rail 5 and forms an end stop 10*a*, against which the longitudinal side edges of the guide rail 5 rest, so that the insert element 10 is secured in this position inside the guide rail 5. Each insert element 10, 11 is preferably an injection-molded plastic part.

FIG. 2 furthermore shows that the insert element 10 is provided with a guide 19, in which a bolt 20 is guided along with a connected holder in the form of a cage 21. The bolt 20 and the cage 21 consist of metallic, electrically conductive materials.

The cage 21 has a cube-shaped contour and is provided with a thread bore in the rear wall, through which the bolt 20 extends. The front wall of the cage 21 contains an opening 21*a*, in which a free end of the chain 9 is positioned. The opening 21*a* has a rectangular cross section. For the position of the cage 21, shown in FIG. 2, the opening 21*a* is positioned on edge, so that the chain 9 fits against the narrow edges of the opening 21*a* and is secured in this way. To insert the chain 9, the cage 21 is rotated by 90°, relative to its longitudinal axis, so that the broad side of the opening 21*a* extends in horizontal direction. In this position, the chain 9 can be inserted into and removed from of the opening 21*a*.

The bolt 20 and the cage 21 jointly form the fixture for tensioning the chain 9 that functions as guide element. The bolt 20 at the back of the respective insert element 10, 11 can be turned in order to tension the chain 9. With respect to the mechanical configuration and the design of the tensioning fixture for the guide element, the insert elements 10, 11 are embodied identical, so that they can be inserted optionally into the left end or the right end of the guide rail 5.

The insert element 10, which is connected to the control unit 16, is additionally provided with power supply means and components of electrical plug connectors for the electrical connection to the control unit 16. Corresponding additional components of electrical plug connectors for the electrical contacting are also provided in the control unit housing 17.

FIG. 2 shows that two electrical spring-loaded contacts 22, 23 as components for the electrical plug connectors are provided on the inside wall of the insert opening 18 in the housing 17 for the control unit 16. The electrical spring-loaded contacts 22, 23 are thin sheet-metal segments, which are secured inside recesses in the inside wall of the control unit housing 17, such that they are bent upward somewhat and project into the insert opening 18. The longitudinal axes of the electrical spring-loaded contacts 22, 23 extend in longitudinal direction of the insert opening 18 and thus in longitudinal direction of the guide rail 5, inserted therein. In the present case, the electrical spring-loaded contacts 22, 23 are embodied identical. Each of the electrical spring-loaded contacts 22, 23 has an end section 22*a*, 23*a* that projects in upward direction over the inside wall of the insert opening 18. Each of the ends 22*a*, 23*a* is connected to a cable 24, 25, which is connected to a circuit board, not shown herein, with thereon arranged electronic components for the control unit 16. For the connection to an electrical spring-loaded contact 22, 23, each cable 24, 25 is provided with a metal eyelet 26, 27 at its longitudinal-side end 22*a*, 23*a*.

The first electrical spring-loaded contact 22 is fitted directly onto the end strip 5*c* of the guide rail 5 during the insertion of the guide rail 5 into the insert opening 18 of the control unit housing 17, thus establishing electrical contact with the guide rail 5 without requiring further connecting elements.

Contact is established between the second electrical spring-loaded contact 23 of the control unit housing 17 and an electrical contact on the top of the insert element 10. This contact is embodied for the present case as additional spring-loaded contact 28, wherein solid contacts can also be used in principle. The electrical spring-loaded contact 28 is secured in its position inside recesses of the insert element 10, such that it is bent up slightly and projects over the top of the insert element 10. The longitudinal axis of the electrical spring-loaded contact 28 of the insert element 10 that is positioned inside the guide rail 5 extends in longitudinal direction of the guide rail 5. The electrical spring-loaded contact 28 of the insert element 10 preferably is made of the same material as the electrical spring-loaded contacts 22, 23 of the control unit housing 17. The position of the electrical spring-loaded contact 28 on the insert element 10 is selected such that after inserting the guide rail 5 with the insert element 10 into the insert opening 18 of the control unit housing 17, the electrical spring-loaded contact 23 of the control unit housing 17 rests with contact pressure against the electrical spring-loaded contact 28 of the insert element 10, thus forming an electrically conductive connection between the control unit 16 and the insert element 10.

The electrical spring-loaded contact 28 of the insert element 10 is conductively connected via power supply means to the tensioning fixture 12, 13 for the guide element and thus also to the chain 9 since the tensioning fixture 12, 13 for the guide element consists of electrically conductive components. A metal ring 29 that is positioned on the bolt 20, a conductive section 30 that is connected to the ring 29, as well as a following metal eyelet 31 for making contact with one end 28*a* of the electrical spring-loaded contact 28 are provided as power supply means. The conductive section 30 in general can be a cable, a section of cable, or the like. With the aid of the power supply means embodied in this way, a conductive connection can be established between the electrical spring-loaded contact 28 and the chain 9, which requires low expenditure.

The metal ring 29 according to one particularly advantageous embodiment is formed integrally with the following conductive section 30, which is furthermore embodied integrally with the electrical spring-loaded contact 28.

The control unit housing 17 functioning as connecting housing, together with the insert opening 18 and the therein installed electrical spring-loaded contacts 22, 23, thus has an interface that allows realizing an electrically conductive connection for supplying power to the electric motor via the guide rail 5 and the chain 9, simply by fitting the housing onto the guide rail 5 with the insert element 10.

Figure 3:
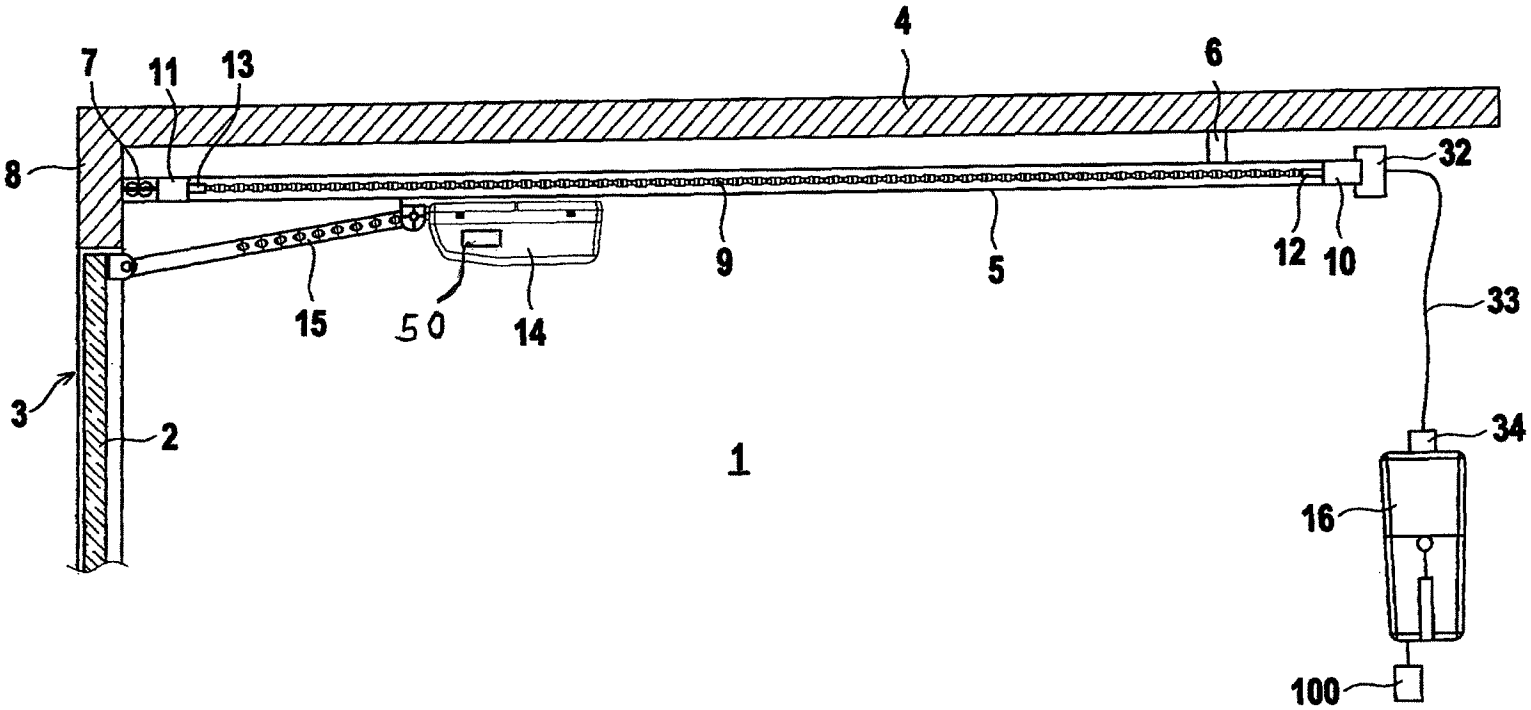
FIG. 3: A schematic representation of a second exemplary embodiment of a drive unit for a door.

FIG. 3 shows a variant of the drive unit 1 according to FIG. 1. The drive unit 1 according to FIG. 3 for the most part also corresponds to the embodiment shown in FIG. 1. In contrast to the embodiment according to FIG. 1, the control unit housing 17, illustrated in FIG. 3, is not fitted onto the guide rail 5, but is mounted at a distance thereto on a garage wall.

Power to the electric motor for the embodiment shown in FIG. 3 is also supplied via the guide rail 5 and the chain 9. A connecting housing that can be fitted onto the guide rail 5 with therein positioned insert element 10 is again provided for the electrical connection between the guide rail 5 and the chain 9 to an external power source. The connecting housing in this case is not the control unit housing 17 for the control unit 16, but an adapter 32. A cable 33 leads from the adapter 32 to a different adaptor 34, which is connected to the control unit 16.

The first adapter 32 can be fitted onto the guide rail 5 with therein disposed insert element 10. The contacting takes place via electrical plug connectors, analog to the embodiment shown in FIG. 1. It is particularly advantageous if the contacting means are embodied as shown in FIG. 1. The insert element 10 of the embodiment according to FIG. 3 in that case is identical to the insert element 10 according to FIG. 1. The adapter 32 comprises an insert opening 18 with electrical spring-loaded contacts 22, 23, which are identical to the corresponding components of the control unit housing 17 shown in FIG. 1.

The second adapter 34 also forms a plug connection with the control unit housing 17. It is particularly advantageous if the control unit housing 17 according to FIG. 3 is embodied completely identical to the control unit housing 17 according to FIG. 1, especially with respect to the design of the electrical plug connectors. The adapter 34 forms a complementary connection for this. As a result of the compatible connection to the embodiment according to FIG. 1, it is ensured that the control unit housing 17 can optionally be connected directly to the guide rail 5, as shown in FIG. 1, or can be connected via the adapters 32, 34 as shown in FIG. 3.

The invention claimed is:

1. A drive unit for a door, comprising:

a guiding device that extends in a movement direction of the door and comprises a guide rail and a guide element;

a carriage including a drive device disposed inside the carriage, the carriage being movable back and forth along the guide rail and being engaged with the guide element, wherein the drive device is supplied with power via the guide rail and the guide element; and electrical plug connectors arranged to electrically connect the guide element and the guide rail to an external power source;

a connecting housing fitted onto the guide rail and comprising first and second electrical spring-loaded contacts that constitute components of the electrical plug connectors;

an insert element positioned in the guide rail and including a tensioning fixture arranged to tension the guide element and a power supplying mechanism to supply electrical power to the guide element, wherein the connecting housing is fitted onto the insert element; and a third electrical spring-loaded contact, wherein the second electrical spring-loaded contact is positioned on a wall of the insert element, makes electrical contact with the third electrical spring-loaded contact, and is electrically connected via the power supplying mechanism to the guide element.

2. The drive unit according to claim 1, wherein the first electrical spring-loaded contact makes direct contact with the guide rail.

3. The drive unit according to claim 1, wherein the third spring-loaded contact is arranged on the insert element.

4. The drive unit according to claim 1, wherein the power supplying mechanism conducts power from the third electrical spring-loaded contact to the tensioning fixture, which is conductively connected to the guide element.

5. The drive unit according to claim 4, wherein the power supplying mechanism is embodied integrally with the electrical spring-loaded contacts.

6. The drive unit according to claim 4, wherein the tensioning fixture comprises a bolt, a holder for the guide element positioned on a bolt and a conductive ring enclosing the bolt and comprising a component of the power supplying mechanism.

7. The drive unit according to claim 6, wherein the power supplying mechanism includes conductive eyelets for the connection to the respective electrical spring-loaded contacts.

8. The drive unit according to claim 7, wherein the guide rail comprises a C-shaped profile and the guide element comprises a chain disposed on the inside of the C-shaped profile.

9. The drive unit according to claim 8, wherein the guide rail has side walls and a top with an opening, and end strips adjoin the side walls and delimit the opening in the top wall, wherein the third electrical spring-loaded contact is exposed inside the opening and wherein one of the end strips is electrically conductive and electrically coupled to the first electrical spring-load contact.

10. The drive unit according to claim 1, wherein the connecting housing has an insert opening into which the guide rail with the insert element is inserted.

11. The drive unit according to claim 10, wherein the connecting housing is secured in its position on the guide rail.

12. The drive unit according claim 10, wherein the first and second electrical spring-loaded contacts project from an inside wall of the connecting housing, which delimits the insert opening.

13. The drive unit according to claim 12, wherein the first and second electrical spring-loaded contacts are arranged parallel to each other and extend in an insertion direction on the connecting housing, and wherein the insertion direction is in the longitudinal direction of the guide rail.

14. The drive unit according to claim 1, further including an adapter, the connecting housing being a component of the adapter, and the drive device further includes a cable that leads from the adapter to a control unit.

15. The drive unit according to claim 1, wherein the connecting housing comprises a control unit housing with therein integrated control unit.

* * * * *